United States Patent [19]

Halene et al.

[11] 4,317,348

[45] Mar. 2, 1982

[54] MAKING CONTOURED HOLLOWS

[75] Inventors: Clemens Halene, Düsseldorf; Josef Schlichting, Dinslaken; Karl Strack, Herne, all of Fed. Rep. of Germany

[73] Assignee: Mannesmann Aktiengesellschaft, Düsseldorf, Fed. Rep. of Germany

[21] Appl. No.: 183,720

[22] Filed: Sep. 3, 1980

[30] Foreign Application Priority Data

Aug. 28, 1979 [DE] Fed. Rep. of Germany ..... 2935086

[51] Int. Cl.[3] ..... B21D 22/10

[52] U.S. Cl. ..... 72/62; 72/58

[58] Field of Search ..... 72/58, 59, 62, 63; 29/421 R

[56] References Cited

U.S. PATENT DOCUMENTS 3,564,886 2/1971 Nakamara ..... 72/62

3,832,877 9/1974 Tominaga ..... 72/62 X 3,858,422 1/1975 Tominaga ..... 72/62

3,979,936 9/1976 Ludwig ..... 29/421 R X 4,179,910 12/1979 Mazier ..... 72/59

*Primary Examiner*—Leon Gilden

*Attorney, Agent, or Firm*—Smyth, Pavitt, Siegemund & Martella

[57] ABSTRACT

A hollow blank, such as a tube, is inserted in between two dies and is also received by two retractable die members. The interior of the blank is closed off, but working fluid is admitted to widen the blank. Widening is at first restricted to a central portion established by conical front faces of the die members. These members are retracted while continued application of fluid pressure progressively widens the blank, urging blank material into continued abutment with the front faces of the receding die members.

7 Claims, 3 Drawing Figures

MAKING CONTOURED HOLLOWS

BACKGROUND OF THE INVENTION

The present invention relates to the making of stepped hollows, each having portions of significantly different cross sectional profiles and contours.

Hollows of the type to which the invention pertains are used, for example, for single-piece or profiled driving shafts. A hollow of such a variety is, for example, made by deforming a tubular blank under internal pressure in a closable, profiled die. The deforming commences freely, i.e., without support from the outside of the hollow, until abutting the wall of the die. If internal pressure is the only deforming force that is being applied, great differences in the final cross section cannot be obtained in that manner. In the case of relatively thin-walled hollows, the ratio of widening, $(D-d/d)$, is limited by the stress in the apex point of tear strength in a stress-strain diagram as applicable to the particular material. Also, this known method produces a final wall thickness that is locally determined by the diameter ratio.

Other methods are known in which internal pressure is combined with an axial compression force acting on the tubular blank. Wall thickness raduction can be controlled to some extent, obviating the last-mentioned problem; but, by and large, the approach is also not completed satisfactorily. Nevertheless, the ratio between large and small diameter (bulging) can be 1.2- to 2-fold the value of the extension or elongation. However, tearing of the tube or formation of folds have to be avoided; this requires that the length of the bulge be limited to twice the diameter of the tube ($l<2d$).

DESCRIPTION OF THE INVENTION

It is an object of the present invention to make a hollow having a large and a small diameter portion, wherein the diameters differ significantly.

It is a specific object of the present invention to widen a portion of a tube over an axial length which is larger than twice the tube's diameter.

It is a more general object of the present invention to work a hollow blank into a hollow, portions of which have significantly different cross sections.

In accordance with the preferred embodiment of the invention, it is suggested to provide a hollow blank such as a tubular blank whose diameter corresponds, e.g., to the smallest diameter of the product to be made. That blank is locally widened at first by application of internal pressure and until abutting a die surface or surfaces. The length of the widened portion is subsequently extended in continued abutment with a support surface of a receding die element or elements until the desired length of the widened portion has be obtained. The residual portion of the blank may remain unwidened. Specifically, in the case of a tube, the interior of the tube is closed off but for a passage of a pressurized working fluid. The tube is then axially compressed and internally pressurized, but the latter is effective in a small portion only; most of the tube is held by die members against radial expansion so that the tube bulges freely outwardly in a limited portion only. Subsequently, these die members recede axially while bulging tube portions are progressively placed in abutment with the receding contoured front faces of these die members; this subsequent widening is not a free one, but is controlled by continuous support of that particular tube portion being widened in any instant. This way, one can widen the tube over a much greater length than twice its diameter.

The novel method as well as the particular machine for carrying out the method and for demonstrating the features of the invention and related objects will be explained with reference to the accompanying drawings. It will become more apparent from that description that the invention provides for a continuously progressing widening process which, for most of its part, is carried out under support of the widened blank from the outside while pressure is applied on the inside. As a consequence, the material experiences a more uniformly distributed stress, peripherally as well as axially.

Proceeding now to the detailed description of the drawings, the machine is provided for working and deforming a tubular blank 1. The machine includes a pair of dies 2 and 2*a*, in between which the blank is centrally positioned. These dies 2 and 2*a* each have trough-shaped die cavities, i.e., semicylindrical cavity portions 20 and 20*a* respectively, which together define a tubular die cavity. This cavity has, generally, the contour of the product to be made and defines, in particular, the widest diameter of that product. These dies are held in a conventional frame 21 and will be moved towards and away from each other, in vertical direction. The figures show these dies in protracted, cavity-closing position, in which they complete a cylindrical, wide-diameter die cavity.

Figure 1:
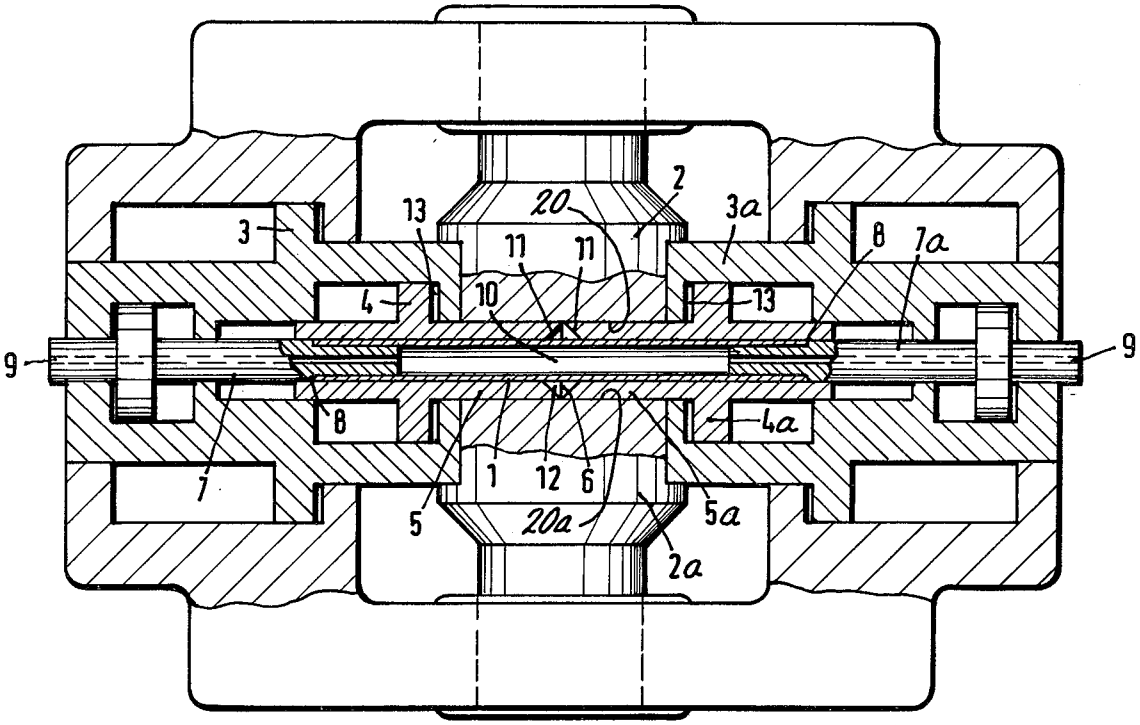
FIG. 1 illustrates a cross section through a machine and equipment in accordance with the preferred embodiment of the invention for practicing the best mode thereof; the machine and equipment is shown just prior to beginning the deformation of a blank.

The machine includes further a pair of similar axial plungers 3 and 3*a*, which are shown in FIG. 1 in an advanced position, towards each other, just prior to beginning the deformation of tube 1. The plungers themselves are hydraulically operated in stand 21, and they, in turn, define piston chambers for the hydraulic operation of several operating elements, to be described next.

Figure 3:
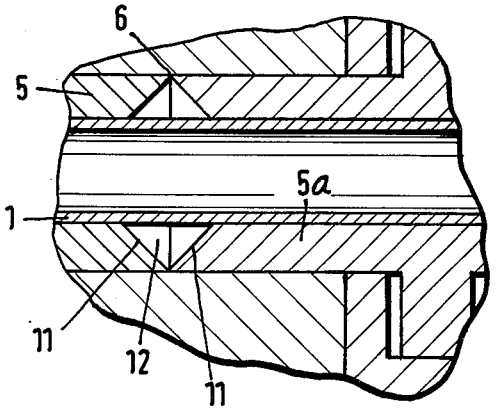
FIG. 3 illustrates a detail of the machine of FIG. 1.

Annular pistons 4 and 4*a*, having particularly annular or tubular sizing portions 5 and 5*a*, receive the tubular blank 1. The sizing portions 5 and 5*a* extend close to each other; they actually touch each other and are generally disposed in the cavity between the die members 2 and 2*a*. Specifically, these elements 5 and 5*a* constitute axially movable die elements, moving horizontally into and from the abutment position shown in FIG. 1. The front ends of these sizing and die elements 5 and 5*a* are shown in greater detail in FIG. 3. They have conical slide or working surfaces 11 and engage each other along a thin, annular interface 6 at the respective farthest points (circle) of projection. Due to the conical front face, recessing axially in radial direction, an annular die cavity 12 is defined to which a small, central portion of the surface of blank 1 is directly exposed initially. The remainder of blank 1 is held radially by the die elements 5 and 5*a*, into which the blank fits rather snugly.

A pair of piston-plungers 7 and 7*a* extend into the interior of tube 1. They each have a sealing shoulder 8 abutting the end of the tube 1. The piston-plungers 7 and 7a are each provided with a bore 9 for application of the pressurized working fluid. The basic function of these elements 7 and 7a is (i) to provide axial pressure against the blank, (ii) to close off the interior of tubular blank 1, and (iii) admit pressurized working fluid into the blank via the ducts 9. The piston-plungers 7 and 7a as well as the die elements 5 and 5a are provided with portions permitting them to be hydraulically operated in elements 3 and 3a.

In operation, the interior space 10 of tubular blank 1 is closed and sealed at the axial ends (8) and by the piston-plungers 7 and 7a, at large. Tube 1 is held concentrically by the elements 5, 5a, 7, and 7a but for the space 12. Pressurized fluid is now applied while the piston-plungers 7 and 7a are axially advanced by means of the hydraulically operated piston portions thereof.

Figure 2:
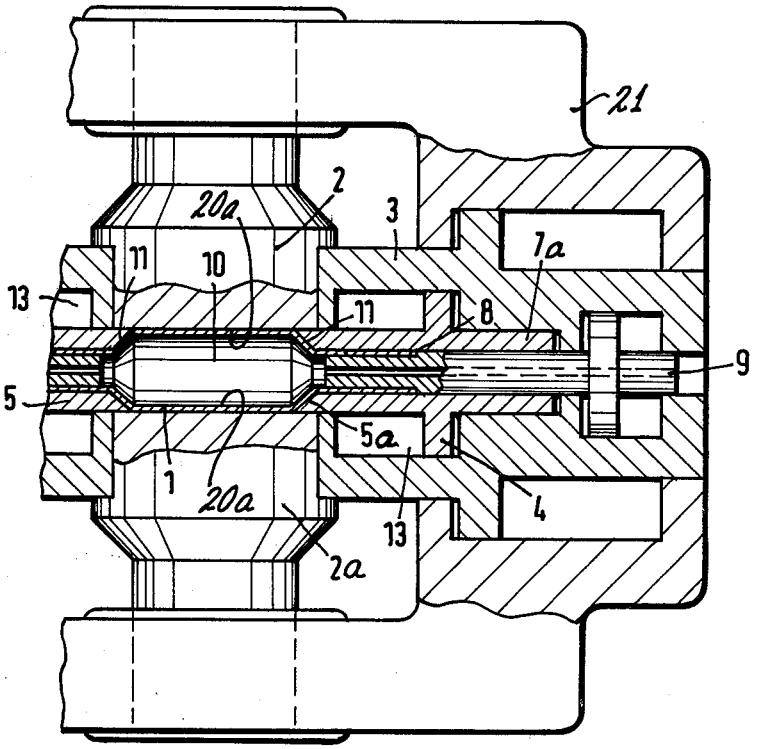
FIG. 2 is a similar view, but after completion of working.

As the interior 10 of the tube is widened at its center, the central (axial) portion of the tube wall expands freely, i.e., without external support, and into cavity 12, until abutting the conical faces 11 of die elements 5 and 5a. Now, these elements 5 and 5a begin to retract; while tube material is urged against the surfaces 11 as well as against the dies 2 and 2a in continued, progressing, supporting abutment. Retraction of the extensions 5 and 5a enlarges axially the space 12 to be occupied peripherally by the widened tube portion. Thus, the widened portion of the tube progresses axially with the receding surfaces 11 of die elements 5 and 5a. This axial progression of the widening is not a free one, but continues under support of, by, and against these surfaces 11. Pressure in chamber 13 controls the retraction piston-die elements 5 and 5a. FIG. 2 shows the final stage of completion; die elements 5 and 5a are completely retracted. Upon retracting plungers 3 and opening dies 2 and 2a, the completed product can be removed. All the while, the dies 2 and 2a acted as radial limits for the widening. In this particular instance, the largest diameter of the product obtained therewith is given by the cylindrical dimensions of the cavity portions in dies 2 and 2a. It is quite feasible, however, to form different profiles; in other words, the diameter of the widened portions may vary in accordance with a particular axial profile contour of die cavities 20 and 20a. Also, radial, i.e., azimuthal, diameter differences may be obtained by properly contouring these cavities. It should be noted that tubular die members 5 and 5a do not have to be in full engagement with the dies 2 and 2a everywhere. Decisive is that upon receding, die members 5 and 5a progressively make available the contour of dies 2 and 2a.

The working surfaces 11 by means of which the axially progressing widening is obtained and controlled (progressively receding support surfaces) may be provided to have axially effective, deforming, stabilizing contour portions extending for about one-half to one-third the axial length of these surfaces 11.

The invention is not limited to the embodiments described above; but all changes and modifications thereof, not constituting departures from the spirit and scope of the invention, are intended to be included.

We claim:

1. Machine for widening a tubular blank, comprising:

a first and a second complementary die having cavity portions defining the widening;

a pair of axially displaceable die elements, retractably positioned in the cavity portions, the die elements having particularly contoured front faces, facing each other in said die cavity, the tubular blank being inserted in the die elements inside said cavity; and a pair of plungers extending into the interior of the die elements and the tubular blank, at least one of the plungers having a bore for passage of pressurized fluid so that the blank is widened towards the particularly contoured front faces and the die cavity, and the widened portions extend axially in abutment with the receding die elements.

2. Machine as in claim 1, the contoured surfaces being, at least in parts, conical.

3. Machine as in claim 1, wherein the die elements retract from each other for a space of more than twice a diameter of the die cavity.

4. Machine for widening a tubular blank, comprising:

first stationary die means defining a tubular die cavity;

a pair of second die means axially movable in the first die means in opposite directions in order to provide for an axial increase in the wide diameter portion of the die cavity, the second die means being hollow receiving a smaller diameter tubular blank; and means for applying pressure to the interior of the tubular blank to urge a central portion of the tubular blank radially outwardly and to cause the central portion to axially increase upon axial retraction of the second means from each other.

5. A method of making a hollow, to have a large and a small diameter portion, comprising the steps of providing a hollow blank having said small diameter;

radially widening a portion of said hollow blank freely until obtaining the large diameter;

and axially increasing the said widened portion under continuous, but receding, support of the hollow from the outside as widening progresses in direction of the receding support.

6. A method of widening a hollow, comprising the steps of inserting the hollow in die means whose cavity defines the outer contour of the final product;

closing most of the interior of the hollow, leaving but a limited cavity space therein;

applying deforming fluid pressure to said limited cavity to obtain a limited expansion;

and gradually increasing said space under conditions of abutment with the hollow to gradually widen the hollow in accordance with said outer contour.

7. A machine for widening hollows, comprising:

first die means having a cavity defining the outer contour of the product to be made, a hollow blank being inserted in the die means;

retractable second die means inserted in the hollow blank and defining a small space therein;

means for applying deforming fluid pressure to said small space to deform adjacent wall portions of the blank into conformity with the cavity;

and means for retracting the second die means to, thereby, enlarge the small space for gradually deforming the tubular blank under fluid pressure, the deforming progressing in direction of the retraction, and in continued abutment with the refracted second die means.

* * * * *